US006438210B1

(12) United States Patent
Castleberry

(10) Patent No.: US 6,438,210 B1
(45) Date of Patent: Aug. 20, 2002

(54) ANTI-SCATTER GRID, METHOD, AND APPARATUS FOR FORMING SAME

(75) Inventor: Donald Earl Castleberry, Niskayuna, NY (US)

(73) Assignee: General Electric Company, Niskayuna, NY (US)

( * ) Notice: Subject to any disclaimer, the term of this patent is extended or adjusted under 35 U.S.C. 154(b) by 0 days.

(21) Appl. No.: 09/536,850

(22) Filed: Mar. 28, 2000

(51) Int. Cl.[7] ..... G21K 1/10
(52) U.S. Cl. ..... 378/154; 378/149
(58) Field of Search ..... 378/154, 147, 378/149; 436/4

(56) References Cited

U.S. PATENT DOCUMENTS

| | | | | |
|---|---|---|---|---|
| 4,706,269 A | | 11/1987 | Reina et al. | 378/154 |
| 5,231,654 A | | 7/1993 | Kwasnick et al. | 378/147 |
| 5,231,655 A | | 7/1993 | Wei et al. | 378/147 |
| 5,293,417 A | | 3/1994 | Wei et al. | 378/147 |
| 5,303,282 A | | 4/1994 | Kwasnick et al. | 378/147 |
| 5,557,650 A | * | 9/1996 | Guida et al. | 378/154 |
| 5,581,592 A | | 12/1996 | Zarnoch et al. | 378/154 |
| 5,606,589 A | | 2/1997 | Pellegrino et al. | 378/154 |
| 5,689,118 A | | 11/1997 | van Beek | 250/505.1 |
| 5,814,235 A | | 9/1998 | Pellegrino et al. | 216/12 |

FOREIGN PATENT DOCUMENTS

| | | | |
|---|---|---|---|
| EP | 731472 A1 | | 7/1996 |
| FR | 2505540 A | | 11/1982 |
| JP | 58-021582 | * | 2/1983 |

OTHER PUBLICATIONS

Rezentes et al., "Mammography Grid Performance", Radiology, vol. 210, No. 1, pp. 227–232, Jan. 1999.

* cited by examiner

*Primary Examiner*—Drew A. Dunn
(74) *Attorney, Agent, or Firm*—Lester R. Hale; Donald S. Ingraham

(57) ABSTRACT

An anti-scatter grid for radiography includes a plurality of generally radiation absorbing elements and a plurality of generally non-radiation absorbing elements in which the generally non-radiation absorbing elements include a plurality of voids. Desirably, the non-radiation absorbing elements include an epoxy or polymeric material and a plurality of hollow microspheres. Disclosed is also an apparatus for forming an anti-scatter grid in which the apparatus includes a pivoting arm and surface for use in aligning a plurality of spaced-apart generally radiation absorbing elements relative to a radiation source.

23 Claims, 4 Drawing Sheets

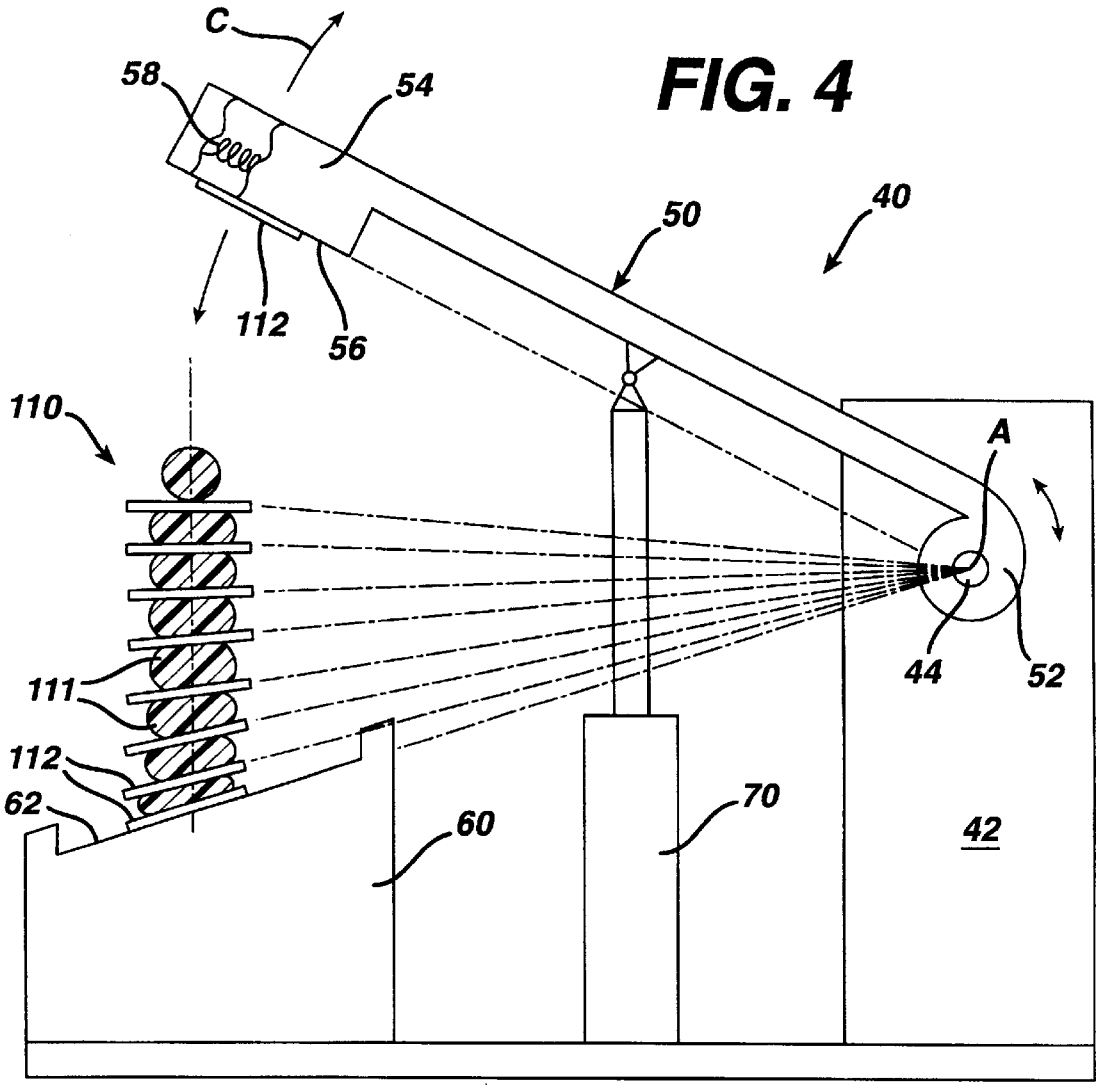
FIG. 4
FIG. 5
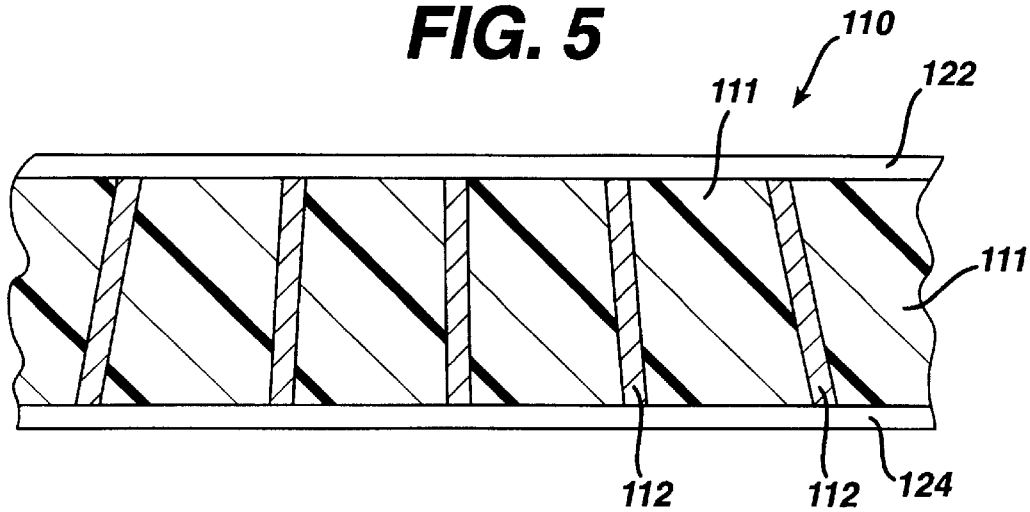

ANTI-SCATTER GRID, METHOD, AND APPARATUS FOR FORMING SAME

BACKGROUND OF THE INVENTION

This invention relates generally to radiography, and more particularly, to an anti-scatter grid for improving radiographic images, and a method and an apparatus for forming an anti-scatter grid.

In medical imaging systems, x-ray radiation that reaches a photosensitive film or detector includes both attenuated primary radiation, which forms the useful image, and scattered radiation, which degrades the image. Often, an anti-scatter grid is inserted between the patient and the photosensitive film or detector to attenuate the scattered radiation while transmitting most of the primary radiation.

One type of anti-scatter grid includes alternating strips of lead foil and interspace material such as a solid polymer material or a solid polymer and fiber composite material. The strips of the lead foil are typically stacked aligned toward the x-ray source to minimize attenuation of the primary radiation. A drawback with using a solid interspace material is that the interspace material exhibits attenuation and scatter of the radiation, which affects the quality of the radiographic image.

Another drawback with this type of anti-scatter grid is that conventional manufacturing processes consist of tediously laminating the individual strips of the lead foil and the solid interspace material, i.e., laboriously gluing together alternating layers of the strips of lead foil and the interspace material until thousands of such alternating layers comprise a stack. Furthermore, to fabricate a focused anti-scatter grid, the individual layers must be placed in a precise manner so as to position them at a slight angle to each other such that each layer is fixedly focused to a convergent point, i.e., to the radiation source.

After the composite of strips of lead foil and the interspace material is assembled into a stack, the stack is then cut and carefully machined along its major faces to the required grid thickness that may be as thin as only 0.5 millimeters. The fragile composite, for example, 40 centimeters by 40 centimeters by 0.5 millimeter, is difficult to handle. If the stack has survived the machining and handling processes, the stack is then laminated with a protective cover along its machined surfaces to reinforce the fragile layered assembly and provide enough mechanical strength for use in the field.

Another type of anti-scatter grid, so called "air cross grid," has a large plurality of open air passages extending through the grid panel. The grid panel is made by laminating a plurality of thin metal foil sheets photo-etched to create through openings defined by partition segments. The etched sheets are aligned and bonded to form the laminated grid panel. Such an anti-scatter grid is labor intensive and expensive to fabricate, and depending on the size of the partition segments subject to damage during manufacture and use.

There is a need for a structurally robust anti-scatter grid capable of increasing the resolution and contrast of radiographic images. There is also a need for an apparatus and a method for forming an anti-scatter grid having a plurality of radiation absorbing strips aligned with a radiation source.

SUMMARY OF THE INVENTION

The present invention provides, in one aspect, an anti-scatter grid for use in radiography in which the anti-scatter grid includes a plurality of generally radiation absorbing elements, a plurality of generally non-radiation absorbing elements for passage of primary radiation through said anti-scatter grid spaced between said plurality of generally radiation absorbing elements, and wherein said plurality of generally non-radiation absorbing elements comprises a plurality of voids.

In another aspect, an apparatus for forming an anti-scatter grid for radiography includes an arm having a first end portion and a second end portion. The first end portion of the arm is pivotable about an axis so that the second portion is movable through an arc. The second end portion has a surface alignable with the axis and the surface is operable to align a plurality of spaced-apart radiation absorbing elements with the axis.

In yet another aspect, a method for forming an anti-scatter grid for radiography includes providing a surface alignable with an axis and moveable along an arc around the axis, providing a plurality of generally radiation absorbing elements, and using the surface to dispose the plurality of generally radiation absorbing elements in spaced-apart relation and to angle the plurality of radiation absorbing elements to align with the axis.

BRIEF DESCRIPTION OF THE DRAWINGS

FIG. 4 is a schematic elevational view of an apparatus for forming an anti-scatter grid according to the present invention;

FIG. 5 is an enlarged cross-sectional view of an anti-scatter grid formed using the apparatus of FIG. 4.

DETAILED DESCRIPTION OF THE INVENTION

Figure 1:
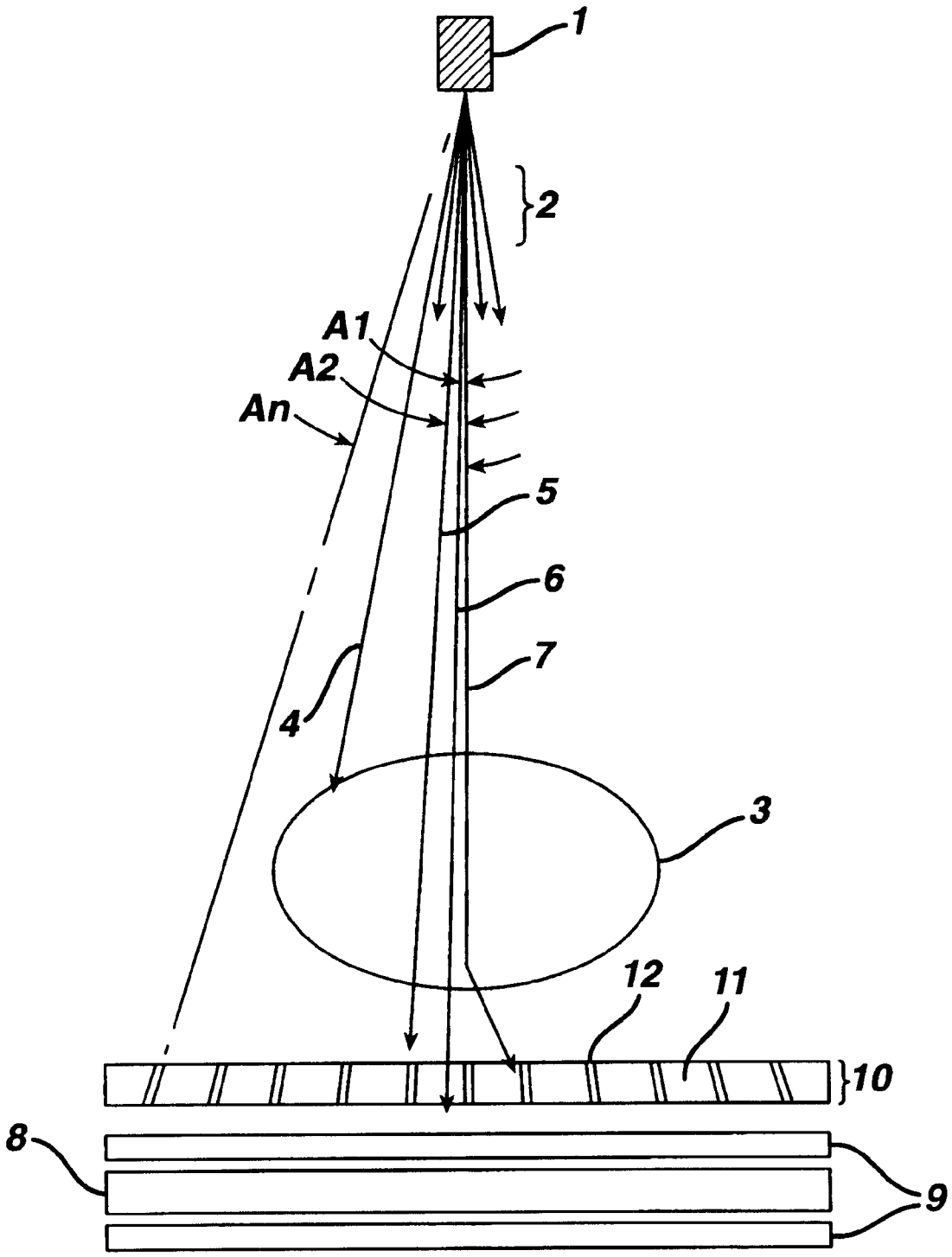
FIG. 1 is an elevational view of a radiographic imaging arrangement having an anti-scatter grid of the present invention.

FIG. 1 is an illustration of a radiographic imaging arrangement. A tube 1 such as an x-ray tube generates and emits x-ray radiation 2 which travels toward a body 3 such as a portion of the body of a patient. Some of the x-ray radiation path 4 is absorbed by body 3, some of the x-ray radiation penetrates and travels along paths 5 and 6 as primary radiation, and still other radiation is deflected and travels along path 7 as scattered radiation. Paths 5, 6, and 7 are exemplary and presented by way of illustration and not limitation.

Radiation from paths 5, 6, and 7 travels toward a photosensitive film 8 where it is absorbed by intensifying screens 9 which are coated with a photosensitive material that fluoresces at a wavelength of visible light and thus exposes photosensitive film 8 (the radiograph) with the latent image.

Alternatively, instead of a photosensitive film, a detector such as a digital x-ray detector (not shown) may be suitably employed. For example, a suitable detector may include a cesium iodide phosphor (scintillator) on an amorphous silicon transistor-photodiode array having a pixel pitch of about 100 micrometers. Other suitable detectors may include a charge-coupled device (CCD) or a direct digital detector which converts x-rays directly to digital signals. While the photosensitive film is illustrated as being flat and defining a flat image plane, other configurations of the photosensitive film and digital detectors may be suitably employed, e.g., a curved-shaped photosensitive film or digital detector having a curved image plane.

An illustrated anti-scatter grid 10 (or collimator) of the present invention is interposed between body 3 and photosensitive film 8 so that radiation paths 5, 6, and 7 intersect anti-scatter grid 10 before reaching film 8. By way of example and not limitation, radiation path 6 travels through one of a plurality of generally non-radiation absorbing elements 11 of anti-scatter grid 10, whereas both radiation paths 5 and 7 impinge upon different ones of a plurality of generally radiation absorbing elements 12 and become absorbed.

The absorption of the scattered beam along radiation path 7 eliminates adverse scattered radiation. The absorption of the beam along radiation path 5 eliminates a portion of the primary radiation. Radiation path 6, representing the remainder of the primary radiation, travels toward the photosensitive film 8 (or other detector) and becomes absorbed by the intensifying photosensitive screens 9 that fluoresce at a wavelength of visible light and thus exposes photosensitive film 8 with the latent image.

The generally non-radiation absorbing elements 11 exhibit a reduced radiation absorption of the radiation used in radiography compared to the generally radiation absorbing elements 12. Desirably, the generally radiation absorbing elements comprise a material and height (which varies based on the angle of the strip as discussed below) operable to absorb at least 90 percent, and preferably at least 95 percent, of the primary radiation which encounters the generally radiation absorbing elements. The generally non-radiation absorbing elements are sized and configured as discussed below and operable to permit passage of at least 90 percent, and preferably at least 95 percent of the primary radiation which encounters the generally non-radiation absorbing elements.

Figure 2:
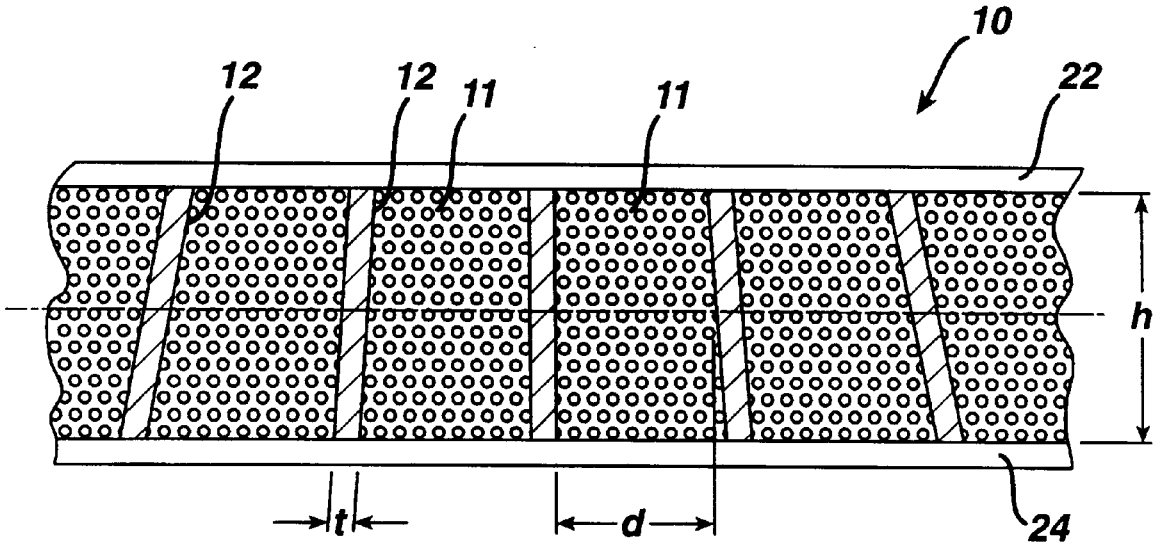
FIG. 2 is an enlarged cross-sectional view of a portion of the anti-scatter grid of FIG. 1.

FIG. 2 is an enlarged cross-sectional side view of a portion of anti-scatter grid 10 of the present invention. The plurality of generally radiation absorbing elements 12 comprises, for example, strips of spaced-apart lead foil. Other suitable generally radiation absorbing materials include tungsten or tantalum. Outer protective covers 22 and 24, typically formed from a graphite epoxy composite, are disposed on the top and the bottom surface for protection of the alternating layers of the generally radiation absorbing elements and the generally non-radiation absorbing elements.

Figure 3:
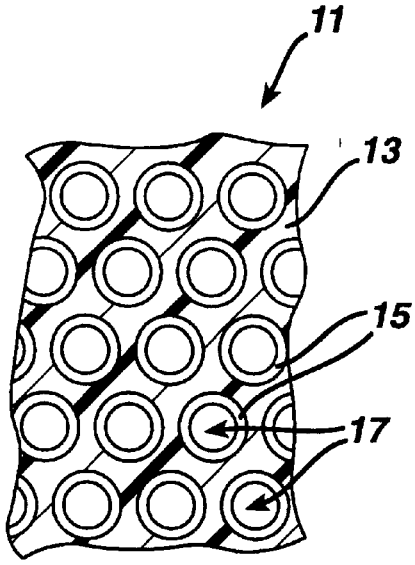
FIG. 3 is an enlarged cross-sectional view of a portion of a generally non-radiation absorbing element of the anti-scatter grid of FIG. 2.

As best shown in FIG. 3, the plurality of generally non-radiation absorbing elements 11 comprises a composite of moldable epoxy or polymeric material 13 and a plurality of hollow air or gas filled microspheres 15. The plurality of hollow microspheres 15 define a respective plurality of voids 17 in generally non-radiation absorbing element 11. Providing voids in the generally non-radiation absorbing elements reduces the amount of attenuation and scatter caused within the anti-scatter grid compared to solid generally non-radiation absorbing elements.

In addition, occupying or filling generally the entire interspace between the spaced-apart generally radiation absorbing elements with the generally non-radiation absorbing elements having a plurality of voids results in anti-scatter grid 10 being structurally robust and capable of absorbing less primary radiation than a conventional anti-scatter grid having solid interspace material and permits a reduction in the amount of radiation necessary to properly expose a photosensitive film or detector during radiography while yielding high resolution and high contrast radiographic images.

The hollow microspheres typically are made of plastic or glass. The hollow microspheres are mixed with an epoxy or other polymer binder to form desirably a rigid material for forming the generally non-radiation absorbing elements. For example, the hollow microspheres commonly are used in a volume fraction resulting in the generally non-radiation elements having about one-quarter of the density of the epoxy or binder alone. Desirably, the epoxy or binder is heat curable so that it can be hardened, e.g., using heat, in a short period of time to allow an anti-scatter grid to be quickly built up a layer at a time, as described in greater detail below.

The average particle size of the hollow microspheres, e.g., the average outer diameter of the spheres, is between about 20 microns and about 150 micrometers, and desirably about 50 micrometers. Suitable glass hollow microspheres include 3M SCOTCHLITE glass bubbles manufactured by 3M Speciality Materials of St. Paul, Minn. Suitable plastic or polymeric hollow microspheres include PHENOSET phenolic microspheres manufactured by Asia Pacific Microspheres Sdn Bhd of Selangor, Malaysia.

The above-noted products are offered as examples. From the present description, it will be appreciated by those skilled in the art that various other materials such as glass, ceramic, or plastic materials or composites thereof may be used for forming the hollow microspheres. In addition, various other epoxy or polymeric materials may be suitably used for the binder or filler interspace material.

In addition, from the present description, it will be appreciated by those skilled in the art that other materials having voids also may be used for the generally non-radiation absorbing elements as the voids therein reduce the radiation absorption and scatter of the radiation while exhibiting sufficient structural integrity compared to the material in solid form. For example, such alternative materials include expanded plastics, open cell foam, closed cell foam, or the like.

For example, materials used in a large number of expanded or foamed compositions include cellulose acetate, epoxy resins, styrene resins, polyester resins, phenolic resins, polyethylene, polystyrene, silicones, urea-formaldehyde resins, polyurethanes, latex foam rubbers, natural rubber, synthetic-elastomers, polyvinyl chloride, and polytetrafluoroethylene.

With reference again to FIG. 2, for medical diagnostic radiography, the grid ratio, which is defined as the ratio between the height h between respective interior surface of protective covers 22, 24 and the average distance d (e.g., taken along a centerline of the grid) between them generally ranges from 2:1 to 16:1. Typical dimensions of the radiation absorbing strips include a height (which varies based on the angle of the strip) and thickness t of about 1.5 millimeters and about 0.02 millimeter, respectively, and a pitch between the strips of about 0.3 millimeter.

FIG. 4 illustrates an apparatus 40 for forming an anti-scatter grid for radiography. Advantageously, apparatus 40 is operable to stack the various layers of the generally radiation absorbing elements and the generally non-radiation absorbing elements, as well as angle the generally radiation absorbing elements to align with a radiation source (for example, to align with angles A1, A2, . . . , An, as shown in FIG. 1).

Apparatus 40 generally includes a support 42, an elongated arm 50, a stand 60, and positioning means 70. Arm 50 includes a first end portion 52 and an opposite second end portion 54. First end portion 52 of arm 50 is pivotally attached to a pivot 44 of support 42 so that first end portion 52 is pivotable about an axis A (shown extending into the page in FIG. 4) and so that second end portion 54 is movable through an arc C. Second end portion 54 of arm 50 includes a generally planar-shaped surface 56 aligned with axis A. Axis A and stand 60 are spaced apart to correspond with the positioning of a radiation source and the anti-scatter grid during radiography.

The operation of apparatus 40 to form an anti-scatter grid 110 is as follows. Initially, a radiation absorbing element 112 such as a lead foil which is sized larger than the desired final anti-scatter grid height, is positioned on an angled surface 62 of stand 60 which desirably corresponds to the angle (e.g., the angle with respect to the path of the center beam of the fan spread of beams emanating from the x-ray source) of an outermost generally radiation absorbing element. A bead of desirably moldable epoxy or polymeric material is deposited on the lead foil to form non-radiation absorbing element 111. Thereafter, the next radiation absorbing element 112, which is also larger than the desired final anti-scatter grid height, is attached to surface 56 of arm 50. Arm 50 is lowered to a spaced-apart position from the first lead foil 112. Desirably, positioning means 70 such as a precision linear actuator can be conventionally controlled to stop arm 50 at a desired position to position the lead foil.

Advantageously, surface 56 is heated. For example, heating means 58 for heating surface 56 may include a heater or a heating coil. Use of a heated surface allows heating the lead foil, which heated lead foil in turn, heats the epoxy or polymeric material to reduce the time necessary to sufficiently cure and harden the epoxy or polymeric material before applying the next layers. This process is repeated until the desired overall grid size is achieved (about 1,000 layers).

From the present description, it will be appreciated by those skilled in the art that for where the angle of the strips relative to the radiation source is small, e.g., a few degrees, surface 62 may be horizontal. While the outermost strip will not be aligned with the axis or radiation source, the interspace material allows the next and remaining layers to be aligned with a radiation source. It will also be appreciated that stand 60 may include an adjustable vertically positionable surface to accommodate various size anti-scatter grids.

The monolithic mass is then machined to the desired anti-scatter grid thickness. As shown in FIG. 5, an anti-scatter grid 110 (or colliminator) formed using apparatus 40 includes alternating layers of generally radiation absorbing elements 112 and solid generally non-radiation absorbing elements 111. Alternatively, an anti-scatter grid having generally non-radiation absorbing elements with voids, as described above, may be formed using apparatus 40.

Protective outer layers 122 and 124, typically graphite-epoxy composite, are laminated on both sides to form a protective outer cover to protect the generally radiation absorbing elements and generally non-radiation elements absorbing from scratches. Any of a variety of finishing techniques such as polishing, painting, laminating, chemical grafting, spraying, gluing, or the like, may be employed to clean or encase the grid to provide overall protection or aesthetic appeal to the grid. Furthermore, the protective layer is useful for safety concerns when the radiation absorbing elements include a metal such as lead.

From the present description, it will be appreciated by those skilled in the art that the positioning means for adjusting the positioning of the spaced-apart radiation absorbing elements may include servo actuated motors, gears, and other suitable mechanisms. Desirably, the depositing of the curable non-radiation absorbing material, and the depositing and the positioning of the radiation absorbing layers are performed automatically.

Figure 6:
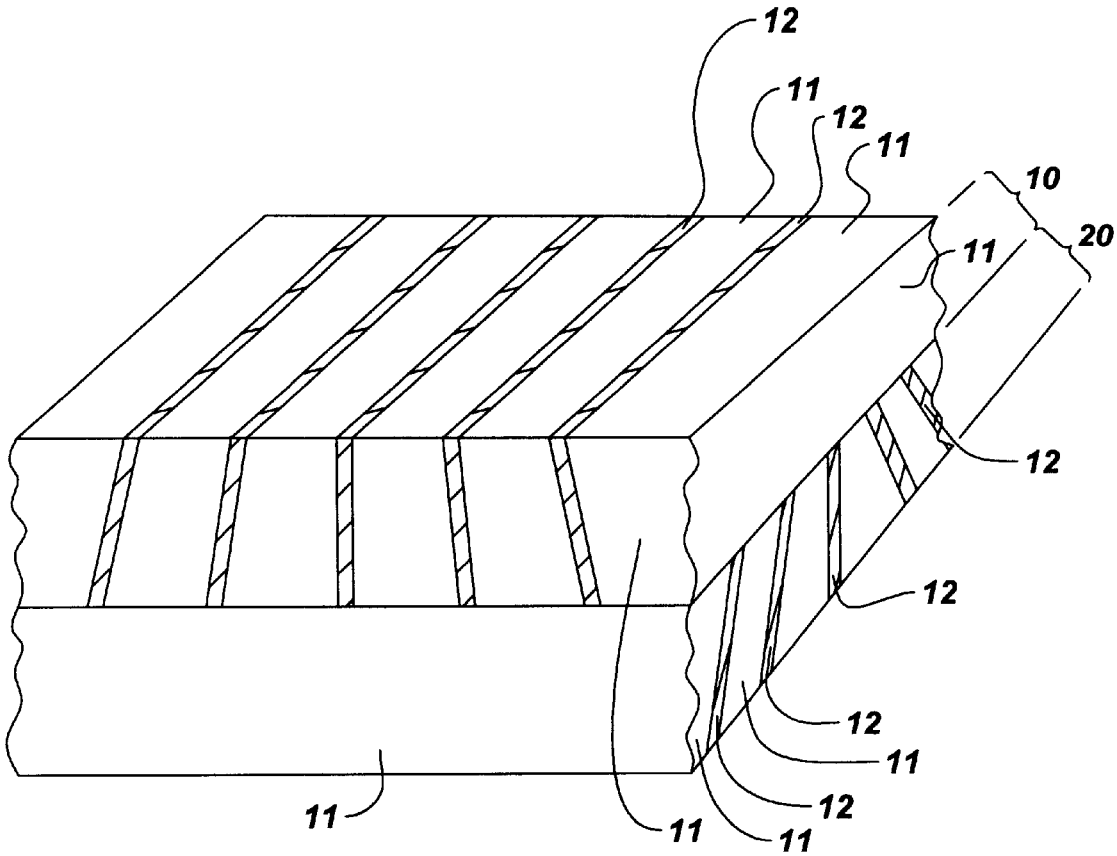
FIG. 6 is an enlarged cross sectional view of a portion of a first anti-scatter grid disposed directly on a portion of second anti-scatter grid.

The attenuation in the anti-scatter grid of the present invention may be made low and without appreciably increasing the amount of radiation used (e.g., the dose experienced by the patient) and a further reduction in the scattered radiation may be achieved by stacking two anti-scatter grids with the radiation absorbing strips 12 of FIG. 6 of the first anti-scatter grid 10 orientated orthogonally compared to the orientation of the radiation absorbing strips 12 of the second anti-scatter grid 20.

Thus, while various embodiments of the present invention have been illustrated and described, it will be appreciated to those skilled in the art that many changes and modifications may be made thereunto without departing from the spirit and scope of the invention.

What is claimed is:

1. An anti-scatter grid for use in radiography, said anti-scatter grid comprising:

a plurality of generally radiation absorbing elements;

a plurality of generally non-radiation absorbing elements for passage of primary radiation through said anti-scatter grid spaced between said plurality of generally radiation absorbing elements; and wherein said plurality of generally non-radiation absorbing elements comprises a plurality of voids and a plurality of hollow microspheres defining said plurality of voids.

2. The anti-scatter grid of claim 1 wherein said plurality of generally non-radiation absorbing elements comprises a heat curable material.

3. The anti-scatter grid of claim 1 wherein said plurality of generally non-radiation absorbing elements comprises at least one of an epoxy and a polymeric material.

4. The anti-scatter grid of claim 3 wherein said plurality of generally non-radiation absorbing elements has a density of about one-quarter the density of said at least one of said epoxy and said polymeric material.

5. The anti-scatter grid of claim 1 wherein said plurality of generally radiation absorbing elements comprises a material different from said plurality of generally non-radiation absorbing elements.

6. The anti-scatter grid of claim 5 wherein said plurality of generally radiation absorbing elements comprises lead, and said plurality of generally non-radiation absorbing elements comprises at least one of an epoxy and a polymeric material.

7. The anti-scatter grid of claim 1 wherein said plurality of generally radiation absorbing elements and said plurality of generally non-radiation absorbing elements comprise alternating layers thereof.

8. The anti-scatter grid of claim 1 further comprising a first protective cover and a second protective cover, and wherein said plurality of generally radiation absorbing elements and said plurality of generally non-radiation absorbing elements are disposed between said first protective cover and said second protective cover.

9. The anti-scatter grid of claim 1 wherein said plurality of generally radiation absorbing elements comprises a plurality of spaced-apart strips and wherein a portion of the spaced-apart strips is angled to align with a radiation source.

10. An anti-scatter grid comprising first and second anti-scatter grids according to claim 9 and wherein said spaced-apart strips of said first anti-scatter grid is disposable at about a right angle relative to said spaced-apart strips of said second anti-scatter grid.

11. A structurally robust anti-scatter grid for radiography, said anti-scatter grid comprising:

a plurality of spaced-apart generally radiation absorbing elements;

a plurality of generally non-radiation absorbing elements for passage of primary radiation through said anti-scatter grid disposed and extending generally entirely between said plurality of spaced-apart generally radiation absorbing elements; and wherein said plurality of generally non-radiation absorbing elements comprising a plurality of voids and a plurality of hollow microspheres defining said plurality of voids.

12. The anti-scatter grid of claim 11 wherein said plurality of generally non-radiation absorbing elements comprises a heat curable material.

13. The anti-scatter grid of claim 11 wherein said plurality of generally non-radiation absorbing elements comprises at least one of an epoxy and a polymeric material.

14. The anti-scatter grid of claim 13 wherein said plurality of generally non-radiation absorbing elements has a density of about one-quarter the density of said at least one of said epoxy and said polymeric material.

15. The anti-scatter grid of claim 11 wherein said plurality of generally radiation absorbing elements comprises a material different from said plurality of generally non-radiation absorbing elements.

16. The anti-scatter grid of claim 15 wherein said plurality of generally radiation absorbing elements comprises lead, and said plurality of generally non-radiation absorbing elements comprises at least one of an epoxy and a polymeric material.

17. The anti-scatter grid of claim 11 wherein said plurality of generally radiation absorbing elements and said plurality of generally non-radiation absorbing elements comprise alternating layers thereof.

18. The anti-scatter grid of claim 11 further comprising a first protective cover and a second protective cover, and wherein said plurality of generally radiation absorbing elements and said plurality of generally non-radiation absorbing elements are disposed between said first protective cover and said second protective cover.

19. The anti-scatter grid of claim 11 wherein said plurality of generally radiation absorbing elements comprises a plurality of spaced-apart strips and wherein a portion of the spaced-apart strips is angled to align with a radiation source.

20. An anti-scatter grid comprising first and second anti-scatter grids according to claim 19 and wherein said spaced-apart strips of said first anti-scatter grid is disposable at about a right angle relative to said spaced-apart strips of said second anti-scatter grid.

21. A method for forming a structurally robust anti-scatter grid for radiography, the method comprising:

providing a surface alignable with an axis and moveable along an arc around the axis;

providing a plurality of generally radiation absorbing elements;

providing a plurality of generally non-radiation absorbing elements comprising a plurality of voids; and using the surface to dispose the plurality of generally radiation absorbing elements in spaced-apart relation with the plurality of generally non-radiation absorbing elements extending generally entirely between the plurality of generally radiation absorbing elements, and to angle the plurality of radiation absorbing elements to align with the axis;

wherein said plurality of generally non-radiation absorbing elements comprises a plurality of hollow microspheres defining said plurality of voids.

22. The method of claim 21 wherein providing the plurality of generally non-radiation absorbing elements comprise providing a moldable material.

23. The method of claim 21 wherein the using the surface comprises using the surface to alternately stack the plurality of generally radiation absorbing elements and the plurality of generally non-radiation absorbing elements.

* * * * *